US005960520A

United States Patent [19]

Conway et al.

[11] Patent Number: 5,960,520

[45] Date of Patent: Oct. 5, 1999

[54] CLIP ASSEMBLIES FOR KEEPING TOWELS, SHEETS AND THE LIKE IN PLACE

[76] Inventors: Suzanne K. Conway, 9623 Sussex St., Naples, Fla. 34109; Diane M. Phillips, 6955 Antelope Dr., Indianapolis, Ind. 46278

[21] Appl. No.: 09/156,791

[22] Filed: Sep. 17, 1998

[51] Int. Cl.[6] ..... A44B 21/00

[52] U.S. Cl. ..... 24/306; 24/499; 24/510

[58] Field of Search ..... 24/306, 302, 489, 24/498, 499, 509, 510, 563, 546, 67.9

[56] References Cited

U.S. PATENT DOCUMENTS

| | | | |
|---|---|---|---|
| 66,431 | 7/1867 | Warner | 24/509 |
| 202,924 | 4/1878 | Brown | 24/510 |
| 1,348,102 | 7/1920 | Freyholtz | 24/510 |
| 1,393,577 | 10/1921 | Ryason | 24/510 |
| 1,677,109 | 7/1928 | Korper | 24/510 |
| 1,877,006 | 9/1932 | Merryman | 24/499 |
| 2,553,070 | 5/1951 | Van Megroot | 24/510 |
| 4,639,980 | 2/1987 | Peterson | 24/306 |
| 4,878,274 | 11/1989 | Patricy | 24/306 |
| 5,388,284 | 2/1995 | Garnett | 24/563 |

*Primary Examiner*—Victor N. Sakran
*Attorney, Agent, or Firm*—D. D. McGraw

[57] ABSTRACT

A clip assembly for holding a towel, sheet or the like relative to an item such as a chair, table or bed so as to prevent undesirable movements thereof relative to such item due to wind, occupant movements, or tilting or upsetting of the item. The clip assembly in all forms has a clip having sections each having a handle at one end and toothed gripping formations at the other end, the clip sections being pivotally movable relative to each other about a pivot axis and being spring biased by a spring to continually urge the handles arcuately apart and the toothed gripping formations arcuately toward each other. The clip assembly is arranged to be able to be attached to a suitable portion of such item as well as to grip the towel or sheet material. One such arrangement has the clip sections so arcuately shaped between the pivot axis and the toothed gripping formations as to provide an opening in which a part of the item such as a bar can be received therethrough without affecting the operation of the handles and the toothed gripping formations. Others have a strap attached to only one of the handles and adapted to be looped around and fastened to a part of the item. The toothed gripping formations may be formed on internally extending cantilever supports positioned between and laterally spaced from the main bodies of the clip sections so as to provide a cantilever spring force together with the gripping force provided by the spring.

10 Claims, 2 Drawing Sheets

CLIP ASSEMBLIES FOR KEEPING TOWELS, SHEETS AND THE LIKE IN PLACE

BACKGROUND OF THE INVENTION

Clips are generally known which grip a beach towel, and are also attached to a beach chair so as to prevent the towel from being blown off of the chair. Various clips are also generally known which hold table cloths on tables and other items to be partially or completely covered.

FIELD OF THE INVENTION

The invention relates to clip assemblies or holders for keeping a cover such as a towel, blanket or sheet in place on a piece of furniture while the piece of furniture is being subjected to air currents or movements which tend to dislocate part or all of a towel, blanket or sheet placed on the furniture. The holders are also advantageous when someone is sitting or lying on the piece of furniture, and any occupant body movements tend to dislocate the cover.

BRIEF SUMMARY OF THE INVENTION

Structures embodying the invention are essentially spring-biased clip assemblies with arrangements for holding one or more clip assemblies and the cover to which the one or more clip assemblies are attached to an appropriate part of a piece of furniture such as a beach chair, a chaise lounge, bed, table or other structure of similar nature, so that the one or more clip assemblies tend to keep the cloth member from becoming dislodged due to air currents or movements of either the furniture or the occupant of the furniture in the case of furniture normally occupied.

One of the primary uses is in conjunction with a beach chair or pool lounge or similar furniture which has one or more rungs to which clip assemblies embodying the invention may be removably attached. The clip assemblies may also be used with weighted bars which are suspended over at least two oppositely positioned edges of a surface such as a table top and act to prevent the table top cover from lifting or being blown off the table. The clip assemblies may be readily removed from the rungs or bars when it is desired to remove, adjust or relocate the covering.

It is to be understood that in the detailed description below, where the references are made to a beach chair and to a towel, the concepts are also applicable to other items and any type of covering or sheet material to be held in close association with an item. Any of such items, whether or not a piece of furniture, may be partially or wholly covered by a towel, sheet, any cloth material, or any flexible woven or unwoven sheet material. Thus, when for purposes of detailed description reference is made to a beach chair or a towel, the principles and the clip assemblies being described are broad enough to cover uses with any and all of the above-mentioned items to be covered and the above-mentioned coverings, and their reasonable equivalents. The invention disclosed and claimed relates to the various modifications of clip assemblies herein disclosed and their reasonable equivalents, and not to any particular item to be partially or wholly covered or to any particular covering used to cover such items so long as such covering can be gripped by the clip assembly so as to be held in place on or relative to an item with which the covering material is to be associated, either by being covered by such material or having the material being held in a desired predetermined relation to the item, whether or not it is actually covering either part or all of the item. By way of such example, a hanging sheet may be held in position relative to a door opening, or a sheet such as a tarpaulin may be held in place over an object or objects which are not furniture. Items carried in the bed of a pick-up truck may require covering, but neither the item nor the truck bed is a piece of furniture. Yet, one or more of the disclosed clip assemblies embodying the invention herein disclosed and claimed may be used, particularly when the item being gripped by one or more clip assemblies are only to be temporarily gripped and are to be easily released from the clip assemblies.

DETAILED DESCRIPTION OF THE INVENTION

Figure 1:
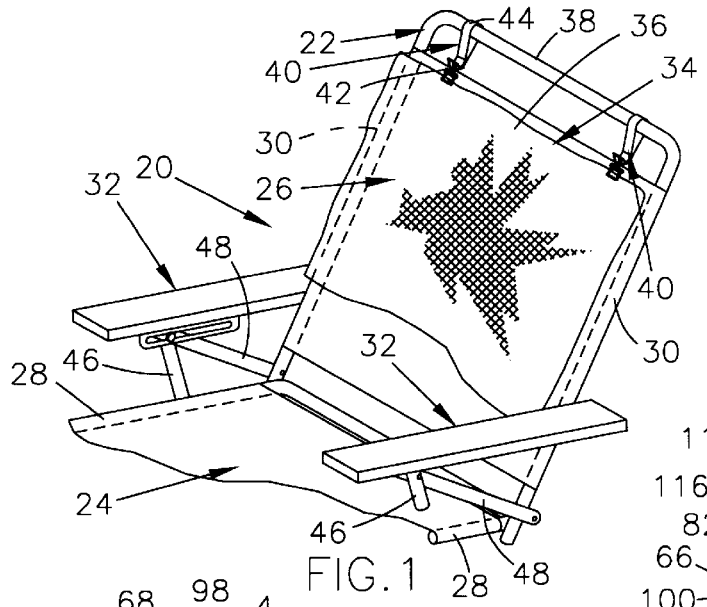
FIG. 1 is a perspective view with parts broken away illustrating the use of two clip assemblies, each being a first embodiment of the invention, holding a towel on a beach chair.

The beach chair 20 of FIG. 1 is somewhat schematically illustrated as including a frame 22 supporting a seat section 24 and a back section 26. In this illustration, the seat and back sections are canvas, with tubular hem portions 28 of the seat section 24 and the tubular hem portions 30 of the back section 26 fitted over portions of the frame 22. Both of the typical arms 32 are also shown. This type of beach chair is of the typical well-known folding variety, making it particularly advantageous to take to the beach.

The towel 34, only the upper end of which is shown with the remainder being broken away, is laid over the back section 26 and the seat section 24, and its upper end 36 is attached to the upper rung or bar 38 of the frame 22 by means of a pair of clip assemblies 40 embodying the invention. While the clip assemblies 40 shown in FIG. 1 are those illustrated in greater detail in FIGS. 2–5, the clip assemblies of FIGS. 6-7 or 8-9, described below, may also be used.

Clip assemblies 40 therefore keep the upper end 36 of the towel 34 from being moved away from the chair 20 should the air currents such as the breezes often found on beach areas tend to blow the towel off of the chair. They also resist the towel's being pulled off or falling off of the chair when a chair occupant moves around or the chair is tilted or overturned so as to tend to dislodge the towel. When it is desired to more completely secure the towel to the seat section 24 of the chair as well, additional clip assemblies embodying the invention may also be mounted on other parts of the frame 22, including the arm supports 46 and 48 or the bare parts of the frame side bars supporting the seat and back sections 24 and 26.

Figure 2:
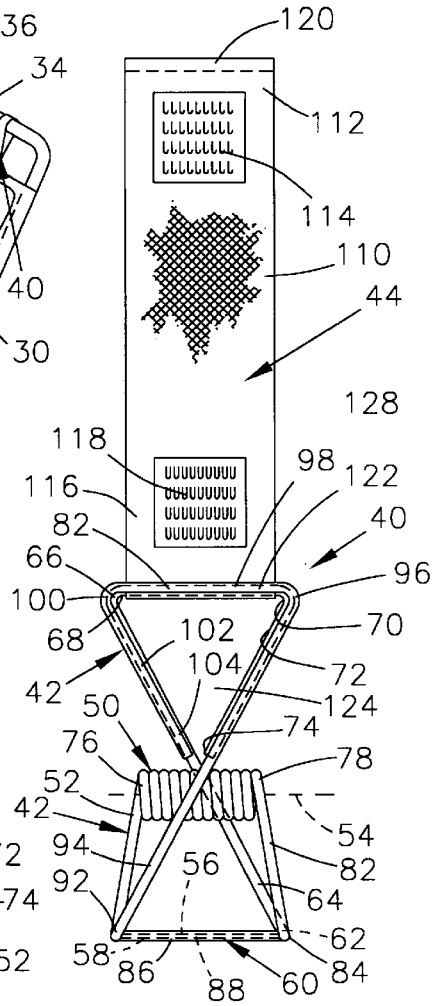
FIG. 2 is a plan view of the clip assembly embodiment of the invention shown in use in FIG. 1. The portion thereof provided to secure the clip assembly to a part of the beach chair is shown in its open position.

The clip assembly 40 of FIG. 2 includes the spring-loaded clip 42 and the attaching strap 44. Clip 42 is shown as a one-piece combination spring and clip. The spring portion of the clip 42 is made of a spiral spring winding 50. One end 52 of spring winding 50 extends laterally outward from the coils forming the spring winding 50 and then is bent to be generally parallel to and laterally spaced from the axis 54 of the spring winding 50 to define the portion 56 thereof having gripping teeth 58 thereon, forming half of the gripping end 60 of the clip 42. The spring end 52 is then reversely bent at 62 so that its portion 64 extends by the coils of spring winding 50 on one side thereof and continues therebeyond to a point 66 where it is again reversely bent to provide another portion 68 which is once again generally parallel to and laterally spaced from the spring winding axis 54, but is positioned substantially on the opposite side of the coils of spring winding 50 from portion 56. It is again reversely bent at 70, where its portion 72 has its end 74 positioned laterally away from spring winding axis 54, but preferably substantially midway between the end coils 76 and 78 of the coils of the spring winding 50.

The other end 82 of spring winding 50 extends laterally outward from the coils forming the spring winding 50 and then is bent at 84 to be generally parallel to and laterally spaced from the axis 54 of the spring winding 50, and also immediately adjacent to and parallel to the portion 56 of spring end 50, to define the portion 86 thereof having gripping teeth 88 thereon, forming the other half of the gripping end 60 of the clip 42. The spring end 82 is then reversely bent at 92 so that its portion 94 extends by the coils of spring winding 50 on the other side thereof from the side where the portion 64 of spring end 52 passes those coils, and continues therebeyond to a point 96 where it is again reversely bent to provide another portion 98 which is once again generally parallel to and laterally spaced from the spring winding axis 54, but is positioned substantially on the opposite side of the coils of spring winding 50 from portion 86. It is again reversely bent at 100, where its portion 102 has its end 104 positioned laterally away from spring winding axis 54.

Figure 4:
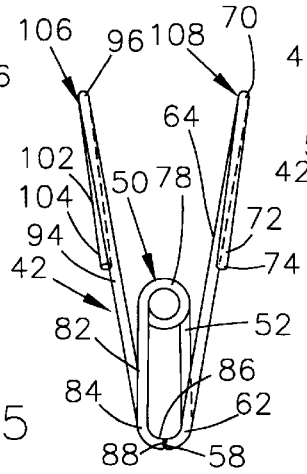
FIG. 4 is a side elevation view of the clip of FIG. 3 taken in the direction of arrows 4—4 of that FIGURE.
Figure 5:
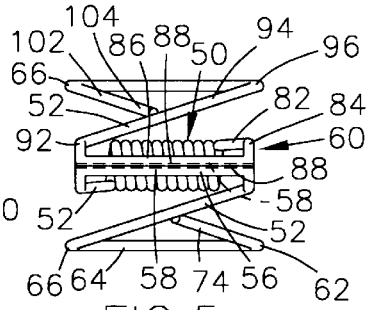
FIG. 5 is a view of the gripping portion of the clip illustrated in FIGS. 3 and 4 taken in the direction of arrows 5—5 of FIG. 3.

The portions 64, 68 and 70 of spring end 52 and the portions 94, 98 and 102 of spring end 82 cooperate to form handles 106 and 108 which are normally spaced apart as is seen in FIG. 4. When they are squeezed together, they cause the teeth 58 and 88 to move apart, permitting the insertion of the towel end 36 between the teeth. The release of the handles 106 and 108 permits the spring force of the spring winding 50 to move the teeth 58 and 88 back toward each other so that they grip opposite sides of the portion of the towel positioned between them. They are again squeezed together to release and remove the towel 34 from the grip of the teeth 58 and 88.

The attaching strap 44 includes the strap body 110. At one end 112 of the strap body 110 there is one component 114 of a fastener unit which is illustrated as comprising the two components of a hook-and-loop type fastener such as that marketed under the trademark Velcro. At the other end 116 of the strap body 110 is the other component 118 of the fastener unit, that component being illustrated as the other component of the hook-and-loop fastener.

Figure 9:
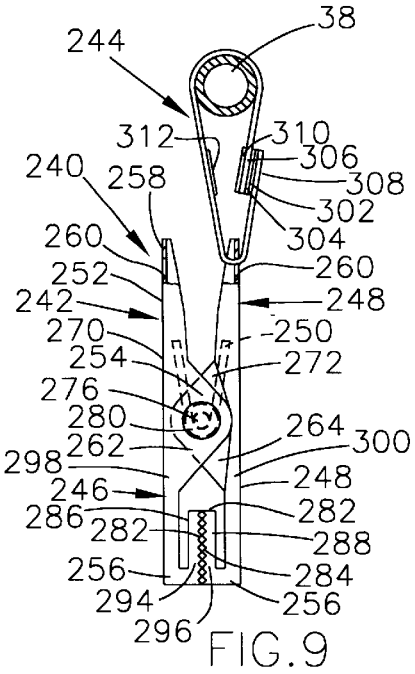
FIG. 9 is a side elevation view of the clip assembly of FIG. 8, taken in the direction of arrows 9—9 of that FIGURE.

Strap 44 has its fastener components 114 and 118 disengaged at least when the strap body 110 is being passed around the rung or bar 38, or other equivalent structure, as shown in FIG. 9, after which the fastener components 114 and 118 are engaged in fastening relation to hold the strap ends 112 and 116 together. It is to be understood that the fastener means defined by the fastener components 114 and 118, when fastened together, must remain fastened as tension forces are applied to the strap between the clip 242 and the rod or bar 38, or its equivalent in other installations, up to a satisfactory tension level for the particular installation in which the clip assemblies are being employed, beyond which they may separate due to excessive tension forces being applied. The strap body ends 112 and 116 are preferably sewn or otherwise secured to respectively define tubular seams 120 and 122. This not only prevents raveling if the strap material is woven so as to have any tendency to unravel, but provides an alternative way for the strap to be attached to the clip 42, as will be further described below.

The fastener unit components 114 and 118 are illustrated in FIG. 1 as being on the same side of the strap body 110, with a portion of the strap body passing through one of the generally triangular shaped openings formed by one of the handles 106 or 108. However, as shown in FIG. 9 and discussed below, the fastener components may be on opposite sides of the strap body. When the fastener components are on the same side of the strap body and are fastened together as shown in FIG. 2, they form a teardrop shaped look as noted below, and when they are on opposite sides of the strap they form a generally circular closed loop, which may at times have a more oval or elliptical shape when having tension thereon, as shown in FIG. 9.

As shown in FIG. 2, the tubular seam 122 of strap body end 116 has had the portion 102 inserted through it and the seam moved until the portion 98 is the part of the spiral spring end 82 received through the seam. Thus the strap is retained on the clip 42 even when it is stored but not actually in use or when the fastener components 114 and 118 are disengaged.

With the fastener unit component 114 being on the opposite side of the strap body 110 from the fastener unit component 118, the strap body end is looped around the portion of the frame 22 to which the clip assembly is to be attached (for example, in FIG. 1, the strap body 110 of each of the clip assemblies 40 is looped around the upper rung or bar 38), the end 112 then passed through the triangular opening 124 formed by portions 94, 98 and 102 of the spiral spring end 52, and the fastener unit component 114 is then attached to the fastener unit component 118, securing the clip assembly to the upper rung or bar 38. The clip handles 106 and 108 are then squeezed together to open the teeth 58 and 88, the towel end is inserted between the teeth, and the clip handles are released. The spring action of the spring spiral winding 50 then closes the teeth into engagement with the towel, holding the towel on the chair 30.

If it is not desired to fasten the end 116 of the strap body 110 to a portion of the clip 42 in the manner above described, the strap end having fastener unit component 118 does not receive the portion 98 of the spring end 82 in its tubular seam 122, but the end 116 is passed through the triangular opening 124 defined in part by portion 98, and the two components 114 and 118 of the fastener unit are engaged, leaving the strap attached to the clip 42 within the loop formed by the entire strap body. When the strap is to be looped about the frame upper rung or bar 38, or another suitable part of the frame 22, the fastener unit is pulled apart, the strap body 110 is then looped around the rung or bar, and the fastener unit halves 114 and 118 are reattached. This manner of looping the strap body is better illustrated in FIG. 9, with a modification of the clip assembly also embodying the invention herein disclosed and claimed.

In FIG. 2, it is shown that the fastener halves 114 and 118 may be on the same side of the strap body 110. Then, when the strap end 116 has its tubular seam 122 receiving portion 98 of the spring end 82, the strap body 110 is looped over the frame part such as rung or bar 38 and the two fastener components 114 and 118 are engaged to secure the clip assembly in place. In this instance, the loop formed by the strap body is more tearshaped rather than oval, and none of the looped portion of the strap passes through the triangular opening of either one of the handles.

It is further within the purview of the invention that two fastener components 114 are provided on strap body end 112, one on each side of the strap body 110. This then permits either of the above-described manners of looping the strap body 110 about the rung or bar 38 or other suitable part of the frame. In any event, it is desirable that the strap body be attached to or looped about only one of the portions 68 or 98 of one of the handles 106 and 108, so that the pull of the towel as it tends to be moved does not cause the two handles 106 and 108 to be forced closer together, thus tending to open the gripping end 60 of clip 42 and release the towel.

It is to be understood that the fastener means defined by the fastener components 114 and 118, when fastened together, must remain fastened as tension forces are applied to the strap between the clip 42 and the rod or bar 38, or its equivalent in other installations, up to a satisfactory tension level for the particular installation in which the clip assemblies are being employed, beyond which they may separate due to excessive tension forces being applied.

Figure 6:
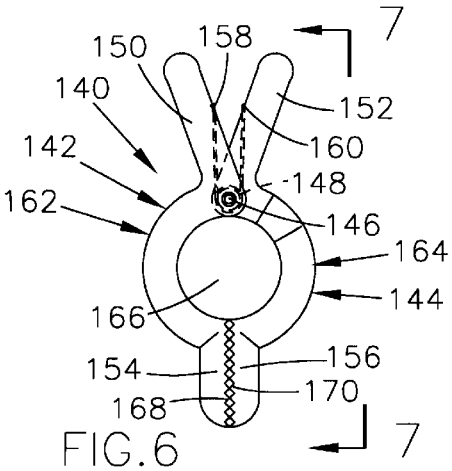
FIG. 6 is a side elevation view of a clip assembly embodying the invention and having a unified part of the clip assembly providing for the mounting of the clip assembly around a bar of the piece of furniture to which a sheet member is being clipped, another unified part of the clip assembly having the gripping surfaces for gripping the sheet member, and another unified part of the clip assembly providing handles for opening the clip assembly against the force of a spring urging the griping surfaces toward engagement with each other to provide a gripping action.
Figure 7:
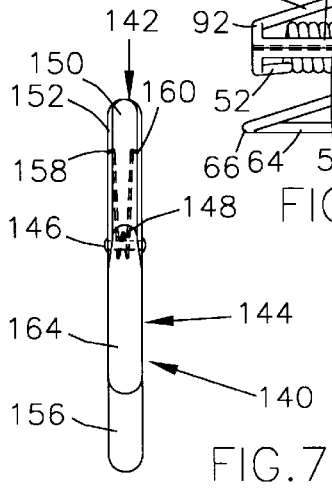
FIG. 7 is an end view of the clip assembly of FIG. 6, taken in the direction of arrows 7—7 of that FIGURE, and is also a schematic representation.

The clip assembly 140 is schematically represented in FIGS. 6 and 7 contain schematic representations of the clip assembly 140, which is a modification embodying the invention herein disclosed and claimed. Clip assembly 140 comprises four basic parts. These are a first clip section 142, a second clip section 144, a pivot pin 146 connecting the two clip sections in pivotal relation within a plane of movement which is parallel to the plane of the drawing's FIG. 6, and a spring 148 fitted to the two clip sections 142 and 144. Spring 148 is illustrated as a folded or bent leaf spring having its bend area joining its spring legs 158 and 160 positioned around the pivot pin 146, preferably in spring-clipped or snapped fashion so that it is movable about the pin but is removably retained on the pin. Spring 148 is so fitted and employed that it continually urges the respective handle ends 150 and 152 of clip sections 142 and 144 arcuately apart, and therefore continually urges the respective gripping ends 154 and 156 of clip sections 142 and 144 toward arcuate engagement. Spring 148 may be a leaf or wire coil spring with a center part receiving the pivot pin 146. In either instance, it has the spring legs or ends 158 and 160 which are spring biased toward increasing their included angle, thus tending to spread them apart. Spring 148 may be a single wire spring or a pair of such springs, one positioned on either end of pivot pin 146 with a coil section through which the pivot pin 146 extends, and outwardly extending spring ends similar to spring legs or ends 158 and 160, the outer ends of which are suitably attached to the handle ends 150 and 152. FIGS. 6 and 7 schematically show the spring legs or ends 158 and 160 having their outer ends wrapping part way around the handles. It is within the purview of the invention that they may be attached to the handle ends 150 and 152 of the clip first and second clip sections 142 and 144 by other suitable means, such as having the spring leg outer ends extending through holes or into recesses formed in the handle ends rather than wrapping around portions of the handle ends. Therefore there are several constructions in which this is accomplished, and within the invention disclosed and claimed so long as the spring legs or ends 158 and 160 are so attached to the handle ends as to permit the spring 148 to continually bias the handle ends 150 and 152 apart.

Although the two clip sections 142 and 144, as seen in FIG. 7, appear schematically of about the same width as they do in thickness, it is to be understood that this is only schematic, and that they may be made with any suitable thickness as seen in FIG. 6 and with any suitable width as seen in FIG. 7, thus providing a broader width for each of the handles 150 and 152 as well a broader width for each of the gripping end 154 and 156 than is schematically shown. Of course, the handles 150 and 152 need not be of the same width as the gripping ends 154 and 156.

The central parts 162 and 164 of the clip sections 142 and 144, respectively, are located between the pivot pin 146 and the gripping ends 154 and 156 of the clip sections 142 and 144. These parts are almost, but not more than, semi-circular in form, as seen in FIG. 6, so that they cooperate to define an opening 166 through which, when installed on the beach chair 20, for example, the upper rung or bar 38 of the beach chair is received by squeezing the handles 150 and 152 together against the spring biasing force of spring 148, pivoting the clip sections 142 and 144 about pivot pin 146 and opening the gripping ends 154 and 156 sufficiently to permit the rung or bar 38 to pass beyond the gripping ends 154 and 156 and be received within opening 166. The towel upper end 36 is then placed between the open gripping ends and the handles 150 and 152 are released. The biasing action of spring 148 then engages the teeth 168 and 170 of the respective gripping ends 154 and 156 with the towel and holds the towel in place in relation to the rung or bar 38 of the beach chair.

In a similar manner, additional clip assemblies 140 may be used in conjunction with other chair frame portions such as arm supports 46 and/or 48, and/or the bare parts of other seat frame parts such as those mounting the seat section 24 and/or the back portion 26 of the chair 20. As will be further described below, other installations provided with suitable rods or rails or bars may accommodate the use of clip assemblies like those schematically shown in FIGS. 6 and 7. It is also to be understood that more than one type of clip assembly may be employed to hold a single towel, sheet, table covering or the reasonable equivalent in place, depending upon the particular structure of the furniture piece to which the clip assemblies are to be attached.

The clip assembly 140 embodies one feature of the invention wherein the major clip body components, which are the first and second clip sections 142 and 144, incorporate the means for attaching the clip assembly to a support member such as rung or bar 138 or its equivalent, the means for gripping a sheet of material to be held in relation to the rung or bar or its equivalent, and the means for opening the gripping mechanism portion of the clip assembly as well as opening the means for attaching the clip assembly to the support member to permit such attachment and to permit the clip assembly to be removed from the rung or bar or its equivalent. Thus, structure performing all of the requisite functions of a clip assembly embodying the invention are integrated into these major components with a suitable spring providing the requisite gripping force acting on these major components.

Figure 8:
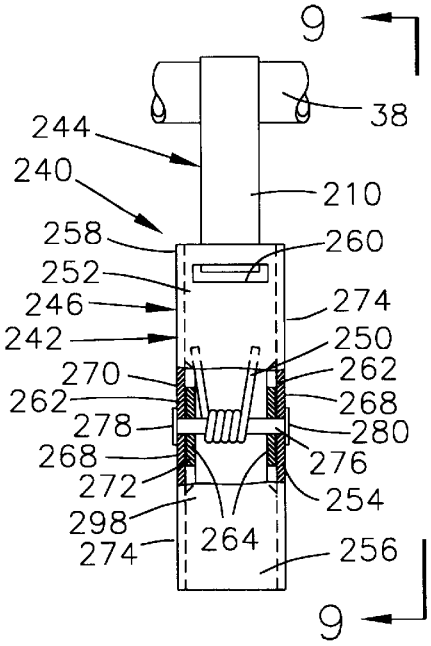
FIG. 8 is a plan view of a clip assembly which is another embodiment of the invention having a mounting arrangement similar to the embodiment of FIG. 2, employing a spring-loaded two-piece body somewhat similar to the embodiment of FIG. 6. The two-piece body has internal cantilever gripping tooth supports which add cantilever spring gripping action to the pivoting spring-bias action of the two pieces forming the clip body.

FIGS. 8 and 9 show another modification of the clip assembly embodying the invention. The clip assembly 240 is usable in many of the scenarios in which the clip assembly 40 or the clip assembly 140 is used. It may not always be usable where the clip assembly 140 is usable, because there can be instances in which the clip body must also be the part of the clip assembly attaching the clip assembly to a support member such as a rail or bar. It is normally usable where the strap and clip combination of clip assembly 40 is usable.

Clip assemblies 240 therefore will keep the upper end 36 of the towel 34 from being moved away from the chair 20 should the air currents such as the breezes often found on beach areas tend to blow the towel off of the chair. They will also resist the towel's being pulled or falling off of the chair when a chair occupant moves around or the chair is tilted or overturned so at to tend to dislodge the towel. They may also be used in the manner shown in FIGS. 10, 11 and 12 when desired.

The clip assembly 240 of FIGS. 8 and 9 includes the spring-loaded clip 242 and the attaching strap 244. Clip 242, better shown in FIG. 9 and the cutaway part of FIG. 8, includes two clip body sections 246 and 248 and a spring 250. Clip body sections 246 and 248 are similar in construction and therefore similar parts are described using the same reference character for both clip body sections, and such common parts are described only with reference to clip body section 246, it being understood that clip body section 248 has the same parts.

Clip body section 246 has long and relatively narrow, yet is sufficiently wide as viewed in FIG. 8 to provide adequate gripping surfaces as will be described. It has a handle end 252, a pivotal mounting portion 254, and a gripping end 256 on the opposite side of the pivotal mounting portion 254 from the handle end 252. Handle end 252 has, at its outer end 258, a slot 260 formed transversely therethrough as shown in plan view in FIG. 8 and in cross section in FIG. 9. The pivotal mounting portion 254 is shaped to provide a pair of pivot pin support buttresses 262 and 264, with pivot pin openings extending transversely therethrough in axial alignment. In order to keep the two clip body sections 246 and 248 identical, one of the buttresses 262 is formed with its outer side 268 being flush with the side edge 270 of the clip body section 246 and the other of the buttresses 264 has its outer side 272 spaced inwardly from the other side edge 274 of that clip body section. Thus, when one clip body section 246 is facing the other clip body section 248 as seen in FIG. 9, the buttresses 262 of each of the two body sections 246 and 248 mesh and overlap with the buttresses 264 of each of those two body sections as seen in the cutaway section of FIG. 8. The pin 276 extends through aligned openings in the two buttresses 262 and the two buttresses 264, and is suitably secured in place. For example, it may be headed in place by forming heads 278 and 280 thereon, or may be formed of two parts, one of which is outwardly threaded from its non-headed end to its head 278 and the other one of which is inwardly threaded from its non-threaded end to its head 280, so that the outwardly threaded one is threaded into the inwardly threaded one between the two pin heads 278 and 280. The particular construction of the pin 276 is not an inventive portion of this disclosure, it only being sufficient to provide a suitably strong pivot pin 276 for the buttresses 262 and 264 and therefore for the clip body sections 246 and 248.

The gripping end 256 of each of the clip body sections 246 and 248 have toothed formations or surfaces 282 and 284 facing in the same direction from the main part of the body sections 246 and 248 as the buttresses 262 and 264 face. These orientations are herein referred to as inward facing since, when the two body sections 246 and 248 are attached together by the pivot pin 276 as seen in FIG. 9, they face inwardly of the clip itself and toward each other. These toothed gripping formations or surfaces 282 and 284 are respectively formed on cantilever-mounted portions 286 and 288, which extend from the clip body portion ends 256 toward the buttresses 262 and 264 in laterally spaced relation from the main parts 298 and 300 of their respective clip body sections 246 and 248. Thus, the portions 286 and 288 have a cantilever spring action which increases the gripping action of them when they grip a sheet or similar part between them. The innermost ends 290 and 292 of portions 286 and 288 may be and are preferably closer together in their free condition than the ends 294 and 296 of portions 286 and 288, those ends 294 and 296 being at the point or line of attachment of the portions 286 and 288 to their respective main parts 298 and 300 of their respective clip body sections 246 and 248. This further enhances the gripping action of the toothed gripping formations or surfaces 282 and 284, since the grip-loading of the toothed surfaces in engagement with a suitable sheet material is increased by the cantilever spring action of the portions 286 and 288.

The attaching strap 244 is illustrated as being comparable to the strap 44 of FIG. 2, with the strap 244 extending through the slot 260 of one of the clip body sections 246 and 248, the slot 260 in clip body section 248 being the one selected. The strap 244 can be just as well inserted through the slot 260 of the other clip body section 246. However, it is not desired that it be inserted through both slots, because tension placed on the looped strap 244 will exert a force on each of the clip body section ends 258 tending to move those ends closer together, thus at least lessening the gripping action of the gripping end 256 on the gripped sheet. When the strap 244 extends through only one of the two openings 260, it does not exert any force on the clip body portion ends 258 tending to open the gripping ends 256.

Strap 244 has oppositely disposed fastener components 302 and 304 on its opposite ends 306 and 308 so that, when the strap forms a loop as seen in FIG. 9, the two components 302 and 304 of the fastener, such as a hook-and-loop fastening means or other suitable fastening means such as those noted above, are secured together after the strap loop is formed over the rung or bar 38 as earlier described with regard to attaching strap 44.

Strap 244 may be constructed with the one end 306 having another hook-and-loop or equivalent fastener component 310 facing in the opposite direction from the other one 302 earlier described. Another hook-and-loop fastener or equivalent component 312 may be provided on the inner surface of the loop formed as shown in FIG. 9, so that the hook-and-loop fastening components or means 310 and 312 are engaged in securing relation at least while the clip assembly is not in use, further keeping the strap in place on the end 258 of the clip body section 248. This fastening means is preferably of a general type which becomes fastened with surface-to-surface contact, with or without pressure being applied, so as to hold two elements together in this area by mechanical means such as with a hook-and-loop fastener, or by magnetic means in which two magnets having opposite polarities arranged to provide magnetic attraction and latching between the two magnets.

Strap 244 has its fastener components 302 and 304 disengaged at least when the strap body is being passed around the rung or bar 38 as shown in FIG. 9, after which the fastener components 302 and 304 are engaged in fastening relation to hold the strap ends 306 and 308 together.

It is to be understood that the fastener means defined by the fastener components 302 and 304, when fastened together, must remain fastened as tension forces are applied to the strap between the clip 242 and the rod or bar 38, or its equivalent in other installations, up to a satisfactory tension level for the particular installation in which the clip assemblies are being employed, beyond which they may separate due to excessive tension forces being applied.

Figure 3:
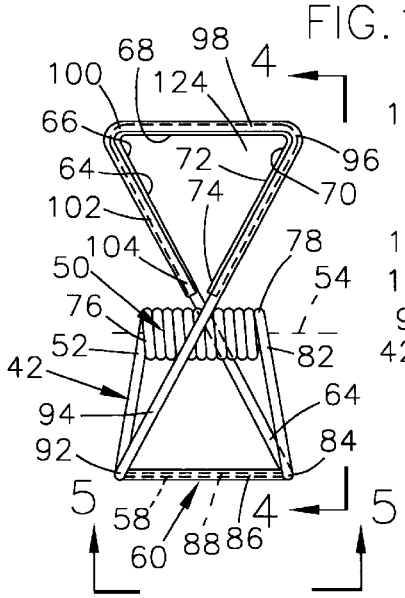
FIG. 3 is a perspective view of a spring-loaded clip forming a part of the clip assembly of FIG. 2.

The clip assembly 240 may be used in much the same manner as the clip assembly 40. Likewise, it may not be appropriate for use when there is no rung or bar, or equivalent structure, available to attach the assembly to for supporting the sheet material being gripped by the toothed surfaces 282 and 284. The clip assembly 240 is opened and released for closure in the same general manner as is either the spring clip 42 of clip assembly 40, as shown in FIGS. 2, 3 and 4, or the clip 140 as shown in FIG. 6.

Figure 10:
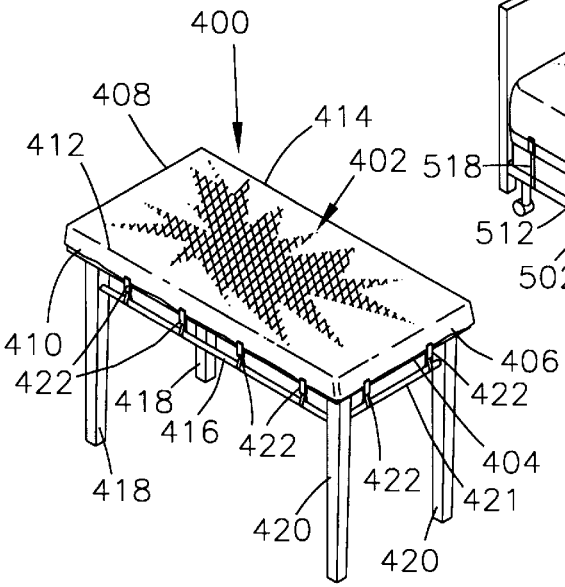
FIG. 10 is a perspective view of a table having a transparent table cover being held in position by clip assemblies embodying the invention, the clip assemblies being secured to suitable rails, bars or handles positioned below the table surface level. A rail or bar may be either temporarily or permanently attached to the table, and one such is shown in this FIGURE. The rail or bar may be suspended from the table cover by clip assemblies embodying the invention in such a manner that it is located below the level of the table top, but its weight acts as an anchor preventing a table cover edge from easily being inadvertently dislodged or lifted up, and one such bar is shown at one table end. If so used, it would be common to have another such bar so suspended from the opposite end or side of the table cover.

FIG. 10 shows a table 400 having a table cloth 402 over it, the table cloth being transparent or translucent so that the table edges may be more easily seen in the drawing. Obviously, the table cloth 402 may be made of any suitable material, woven or not, opaque or not. The end edges 404 of the table cloth 402 extend over the table end edges, with one of the table cloth end edges 404 being shown as extending over the table end edge 406. The other table cloth end edge 404 similarly extends over the table end edge 408, but is not visible in the drawing because of the perspective view.

The side edges 410 of the table cloth 402 extend over the table side edges, with one of the table cloth side edges 410 being shown as extending over the table side edge 412. The other table cloth side edge 410 similarly extends over the table side edge 414, but is not visible in the drawing because of the perspective view.

The bar 416 is shown as being attached to the table 400 by suitable means such as having the ends thereof extending into recesses formed in the table legs 418 and 420. If desired, the bar 416 may be removable. This is particularly desirable when the table is a folding table. Clip assemblies 422 are shown as being attached to the bar 416 and also to the table cloth side edge 410, keeping that side edge below the side edge 412 of the table. Since the same is done on the opposite table side edge 414, the table cloth is held in place on the table. The clip assemblies 422 attached to bar 416 may be any of the modifications shown in the drawing, and are illustrated as one of those clip assemblies having an attaching strap 44 or 244.

The bar 421 at the end edge 406 of the table 400 is not attached to the table, but depends upon its weight to keep the table cloth end 404 below the surface of the top of the table 400. It may also have clip assemblies 422 attached to it, and as before those clip assemblies may be any of the modifications shown in the drawing. However, they are also illustrated as one of those clip assemblies 40 or 240 having an attaching strap 44 or 244.

Figure 11:
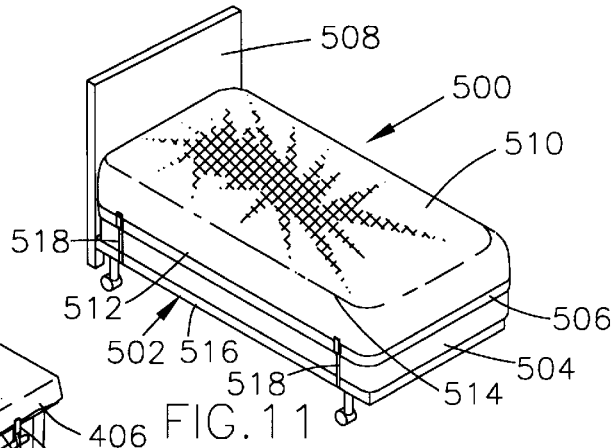
FIG. 11 is a perspective view of a bed having a sheet secured in place on the bed by clip assemblies embodying the invention, the clip assemblies being secured to the bed frame rails supporting the box springs and the mattress.

The bed 500 shown in FIG. 11 is illustrated as having a frame 502 supporting box springs 504 on top of which is a mattress 506. A headboard 508, attached to the frame 502, is also shown. A sheet 510 is shown as being on the bed, with side edges 512 hanging below the mattress side edges, the sheet side edge 512 being so shown in relation to mattress side edge 514. The bed frame 502 includes side rails 516, one of which is seen in the drawing. Clip assemblies 518 are attached to the frame side rails 516 and also to the sheet side edges 512 in a manner similar to those in FIG. 10. Clip assemblies 518 may be either the clip assemblies 40 or 240. When the cross section size and shape of side rails 516 permit, the clip assembly 140 may also be used.

Figure 12:
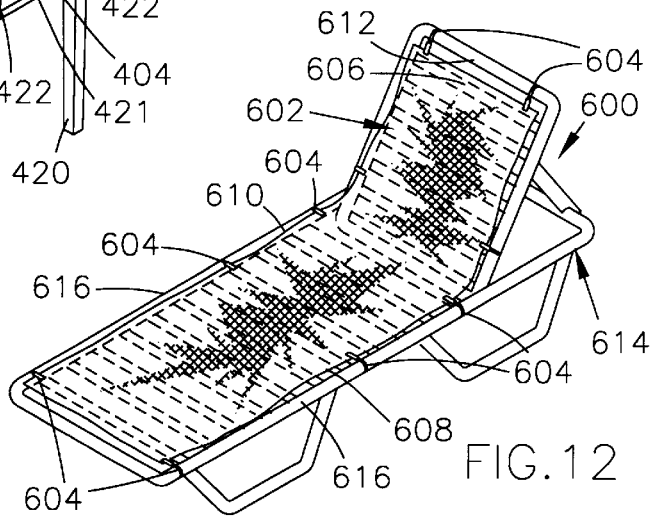
FIG. 12 is a perspective view of a chaise lounge of the type in common use around swimming pools having a beach towel secured by several clip assemblies embodying the invention to the head and side bars forming part of the frame of the chaise lounge.

The chaise lounge 600 of FIG. 12 is shown as having a full length towel 602 on it, held in place by clip assemblies 604 embodying the invention. These clip assemblies may be any of the assemblies 40, 140 or 240. They are shown being attached to the top 606 of the towel 602, and also to its sides 608 and 610, as well as to the top rung or bar 612 of the frame 614 and the side frame bars 616.

There are other examples in which the clip assemblies may be used, such as tarpaulins, tent flys, curtain hangings, and decorative hangings which have a sheet-like format. One of the most common uses, however, has been found to be keeping towels or blankets on beach chairs and poolside chaise lounges. Otherwise, they tend to be blown off or at least rearranged by the wind that is so common near beaches or open areas around swimming pools.

It is to be understood that other multi-component, usually two-component, fastener devices may be substituted for the hook-and-loop type of fastener means illustrated in the modifications of the clip assemblies shown in FIGS. 1, 2 and 8–12 of the drawing which embody the invention herein disclosed and claimed. By way of example but not of limitation, the fastener may be of the hook-and-eye type, snap type, button type, magnetic type, or any other known and commonly used fastener construction which can be used in the place and under any one or more of the conditions normally expected to be encountered when any clip assembly is being employed in the any one or more of the uses noted above or any of their equivalents.

We claim:

1. A clip assembly for attaching a towel or sheet material or the like to an item which supports or is covered at least in part by the towel or sheet material, said clip assembly comprising:

a spring biased clip having:

a first clip section and a second clip section each having first and second ends, said first and second clip sections being connected together for pivotal movements relative to each other about a pivot axis;

a toothed gripping end formed on said first end of each of said clip sections with said toothed gripping ends being positioned relative to each other to be selectively spaced apart and selectively engaged with the towel or sheet material, said toothed gripping ends each having a series of matable teeth formed thereon;

a handle formed on said second end of each of said clip sections;

and spring means acting on said first and second clip sections to continually exert a spring biasing force urging said first and second clip sections in first opposed pivotal directions to move said handles apart and said toothed gripping ends toward each other;

said spring means being overcome by squeezing said handles toward each other and thus pivotally moving said first and second clip sections relative to each other in second opposed directions which are opposite to said first opposed directions of pivotal movements wherein said toothed gripping ends are moved apart to selectively insert a part of any towel or sheet material to be gripped thereby or to release any towel or sheet material gripped therewith;

said spring means acting upon release of said handles to pivotally move said first and second clip sections in said first opposed directions to move said handles arcuately apart and said toothed gripping end toward each other;

said first and second clip sections and said spring means being a single spring wire coiled to provide said spring means and bent to define said handles and said toothed gripping ends, said spring means also being the connection between said first and section clip sections;

and means for attaching said spring biased clip to the item to be covered by or to support the towel or sheet material.

2. The clip assembly of claim 1, said means for attaching said spring biased clip to the item to support or be covered at least in part by a towel or a sheet material being an attaching strap secured to only one of said handles and adapted to be secured to a part of the item to support or be covered at least in part by a towel or sheet material or the like.

3. The clip assembly of claim 1 further having an attaching strap secured to only one of said handles and adapted to be secured to a part of the item to support or be covered at least in part by a towel or sheet material or the like, said attaching strap having a transversely extending tubular seam at one end receiving therethrough a part of said only one handle so as to be secured thereto.

4. The clip assembly of claim 1 in which said attaching strap has matable fastening means which when mating and fastened together form a loop from said attaching strap which is spaced from said tubular seam and is adapted to loop around a part of the item to support or be covered at least in part by a towel or sheet material or the like.

5. The clip assembly of claim 1 in which at least one of said handles has an opening therethrough defined by bent portions of said single spring wire forming said at least one handle, and an attaching strap having a part thereof received through said opening to attach said strap to said at least one handle, said attaching strap having a plurality of fastening means thereon, at least a part of said attaching strap being adapted to form a loop about a portion of the item to support or be covered at least in part by a towel or sheet material or the like so as to attach said clip assembly thereto, at least two of said plurality of fastening means being adapted to be engaged in fastening relation to close the loop.

6. A clip assembly having a plurality of major body components comprising:

first and second clip sections, said clip sections integrally including:

first and second gripping mechanism portions respectively on each of said first and second clip sections and cooperatively defining a gripping mechanism section of said clip assembly, said gripping mechanism section being adapted to grip a sheet of material to be held in relation to a support member, first and second handle portions selectively operable to cooperatively open said gripping mechanism portions of said clip assembly gripping mechanism section by moving them arcuately apart and to move them toward arcuate closure with each other to achieve a closed position in which they are adapted to grippingly engage said sheet of material, and a pivot axis thereon about which said first and second clip sections are pivotally movable relative to each other, said pivot axis being located between one of said handle portions and one of said gripping mechanism portions of each of said first and second clip sections in such manner that when said handle portions are pivotally moved arcuately toward each other said gripping mechanism portions are pivotally moved arcuately away from each other and vice versa;

means adapted to attach said clip assembly to a support member such as a rung or bar or their equivalent;

and spring means acting on both of said clip assembly first and second clip sections to continually urge said gripping mechanism portions arcuately about said pivot axis toward engagement with each other and to continually urge said handle portions arcuately apart about said pivot axis.

7. The clip assembly of claim 6 in which said first and second clip sections each have first and second ends and their said first and second gripping mechanism portions each having a canterlevered part having a series of teeth formed thereon so that each of said series of teeth face each other, said toothed cantilevered parts extending reversely from the outer ends of said first and second clip section first ends so as to be located between and in laterally spaced relation to the parts of said first and second clip sections between said first and second clip section first and second ends and said spring means, said cantilevered parts thus being adapted to exert a cantilevered spring force concurrently with the spring force from said spring means acting to provide gripping force acting through both of said series of teeth when a towel or the like is received between said toothed cantilevered parts.

8. The clip assembly of claim 6 in which said means adapted to attach said clip assembly to a support member is comprised of an integral part of each of said clip sections with each such integral part having a substantially semicircular conformation and being located intermediate said pivot axis and said gripping mechanism portion of the one of said clip sections of which it is an integral part, said two such substantially semicircular conformation integral parts cooperatively defining an open space therebetween which is adapted to receive the aforementioned support member therein so as to attach said clip assembly thereto while said gripping mechanism portions are in their closed position.

9. The clip assembly of claim 6 in which said means adapted to attach said clip assembly to a support member is comprised of a flexible strap having a first end and a second end opposite said first end, said strap being attached to one of said handle portions at the end of said one handle portion positioned away from said pivot axis, said flexible strap having a fastener unit comprising first and second fastener unit components respectively secured to said first and second ends of said strap, said first and second fastener unit components being adapted to be disengaged and to be engaged in fastener-fastened relation, said first and second fastener unit components when engaged in fastening relation causing said strap to complete a closed loop with said strap adapted to have the support member attachably received within said closed loop so that said clip assembly is attached to the support member.

10. The clip assembly of claim 9, in which said first end of said strap has a tubular seam extending transversely thereacross, said first handle portion having a part thereof received through said tubular seam, attaching said strap first end to said first handle portion.

* * * * *